US006580983B2

(12) United States Patent
Laguer-Diaz et al.

(10) Patent No.: US 6,580,983 B2
(45) **Date of Patent: *Jun. 17, 2003**

(54) METHOD AND APPARATUS FOR VEHICLE DATA TRANSFER OPTIMIZATION

(75) Inventors: Juan Laguer-Diaz, San Juan, PR (US); Ashish Puri, Eric, PA (US); James E. Pander, Eric, PA (US)

(73) Assignee: General Electric Company, Schenectady, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/179,648

(22) Filed: Jun. 24, 2002

(65) Prior Publication Data

US 2002/0169530 A1 Nov. 14, 2002

Related U.S. Application Data

(63) Continuation of application No. 09/697,251, filed on Oct. 26, 2000, now Pat. No. 6,434,458.
(60) Provisional application No. 60/162,294, filed on Oct. 28, 1999.

(51) Int. Cl.[7] ..... G06F 7/00

(52) U.S. Cl. ..... 701/35; 701/29; 701/30; 701/33

(58) Field of Search ..... 701/29, 30, 33, 701/35, 36; 705/50

(56) References Cited

U.S. PATENT DOCUMENTS

| | | | | |
|---|---|---|---|---|
| 5,233,513 A | * | 8/1993 | Doyle | 705/7 |
| 5,754,965 A | * | 5/1998 | Hagenbuch | 701/35 |
| 6,085,253 A | * | 7/2000 | Blackwell et al. | 709/235 |
| 6,434,458 B1 | * | 8/2002 | Laguer-Diaz et al. | 701/35 |

* cited by examiner

*Primary Examiner*—Gertrude Arthur
(74) *Attorney, Agent, or Firm*—Carl A. Rowold; John L. DeAngelis, Jr.; Beusse Brownlee Bowdoin & Wolter, P.A.

(57) ABSTRACT

An apparatus and method for identifying and transmitting time critical or high priority files from an on-board monitor aboard a vehicle. During operation of the vehicle, the on-board monitor collects and stores operational parametric information in the form of data files. The data files are transmitted to a remote site on a periodic basis or in response to certain predetermined conditions above the vehicle. To reduce the latency and delay times with transmitting the high priority files, those files are merged and transmitted before the transmission of relatively lower priority data files.

11 Claims, 4 Drawing Sheets

METHOD AND APPARATUS FOR VEHICLE DATA TRANSFER OPTIMIZATION

This patent application claims the benefit of U.S. Provisional Application filed on Oct. 28, 1999 and assigned Application No. 60/162,294, and further is a continuation of patent application Ser. No. 09/697,251 filed on Oct. 26, 2000 now U.S. Pat. No. 6,434,458.

BACKGROUND OF THE INVENTION

The present invention is directed in general to communication systems for vehicles and more specifically to a method an apparatus for optimizing file transfers between a vehicle and a remote site, e.g., a remote monitoring and diagnostic service center.

Establishing, maintaining and managing a communications link between a mobile asset (e.g., an on-road, off-road or rail-based vehicle) can provide opportunities for cost-saving operation through efficient vehicle dispatching and the remote acquisition of vehicle performance information. When the mobile assets comprise a fleet of similar vehicles, economies of scale can result in considerable savings and operational efficiencies. As applied to railroad operations, cost-efficiency requires minimization of locomotive down time and especially the avoidance of line-of-road locomotive failures. Failure of a major locomotive system can cause serious damage, require costly repairs, and introduce significant operational delays in the railroad transportation network. A line-of-road failure is an especially costly event as it requires dispatching a replacement locomotive to pull the train consist, possibly rendering a track segment unusable until the disabled train is moved. As a result, the health of the locomotive engine and other locomotive subsystems is of significant concern to the railroad operator.

In the past, there has been no automatic or systematic mechanism for locomotive fault detection. Instead, the railroad operator relies primarily on regular inspections and the observation of performance anomalies by the locomotive operator. Also, some cursory inspection processes are accomplished while the locomotive is in service. More thorough inspections require the locomotive to be taken out of service for several days. Any locomotive down time, whether for inspection or repair, represents a significant railroad cost that advantageously should be minimized. The same inspection procedures are generally applied to off-road, on-road, and other rail-based vehicles.

One such apparatus for detecting faults, and thereby minimizing locomotive down time, is an on-board monitor that measures performance and fault-related operational parameters of the mobile asset during operation. With timely and nearly continuous access to vehicle performance data, it is possible for repair experts to predict and/or prevent untimely failures. Through the off-board analysis of this information, timely indications of actual and expected component failures can be derived. Also, repair recommendations can be generated to correct failures or avoid incipient problems.

The on-board monitor collects, aggregates and communicates vehicle performance and fault related data from an operating vehicle to a remote site, for example, a remote monitoring and diagnostic center. The data may be collected periodically, when various anomalous or triggering events occur during vehicle operation, or when the vehicle experiences a failure. Generally, the anomalous data and the fault data are brought to the attention of the vehicle operator directly by the vehicle systems, but the vehicle itself lacks the necessary hardware and software devices to diagnose the fault. It is therefore, advantageous to utilize the on-board monitor to collect and aggregate the information and at the appropriate time, send the information to a remote site, for example, a monitoring and diagnostic service center. Upon receipt of the performance data at the monitoring and diagnostic service center, computer based data analysis tools analyze the data to identify the root cause of potential or actual faults. Also, experts in vehicle maintenance and operation analyze the received data to prepare recommendations for preventive maintenance or to correct existing faults or anomalous conditions.

Historical anomalous data patterns or fault occurrences can be important clues to an accurate diagnosis and repair recommendation. The lessons learned from failure modes in a single vehicle can be applied to similar vehicles in the fleet so that the necessary preventive maintenance can be performed before a line-of-service breakdown occurs. When the data analysis identifies incipient problems, certain performance aspects of the vehicle can be derated to avoid further system degradation and further limit violations of operational threshold until the vehicle can undergo repairs at a repair facility.

The on-board monitor aboard the off-road, on-road or rail-based vehicle monitors and collects data indicative of vehicle operation from several vehicle control systems. The on-board monitor interfaces with a communications for transmitting the data collected to the remote site for analysis. When the on-board monitor and its attendant communications system is first installed on board a vehicle, a commissioning process must be executed so that the unique vehicle identification is associated with the unique communications access number or identifier for the communications system on board the vehicle. Whenever information is received at the remote site it is tagged with the communications access number or identifier of the communications system from which it was sent. To properly link the performance information to the correct vehicle, a cross reference table is consulted. Using the communications system number as an index into the table, the unique vehicle identification number associated with the transmitting communications system number is obtained.

Once commissioned, the communications system can establish a link between the operating vehicle and a remote site to transmit fault, anomalous and operational parametric and location information from the vehicle to the remote site. Further, control information and instructions can be uploaded from the remote site to the operating vehicle.

The remote site and the operating vehicle also exchange configuration information. For example, the remote site sends a configuration file to the vehicle to identify the parametric information to be collected and the frequency with which that information is to be collected. Configuration information sent to the operating vehicle also includes identification of certain anomalous or fault events and thresholds used to declare the occurrence of such events. Finally, the configuration process includes a sub-process wherein the version of software programs running on the vehicle are compared with the software version that should be executing on the vehicle, which information is stored at the remote site. To accurately assess the condition of the vehicle based on the downloaded data, the remote site must know the software version running on the vehicle. When a vehicle fails in operation, it is crucial that the parametric operation information collected by the on-board monitor be transmitted as soon as possible to the remote site. If the remote site is a monitoring and diagnostic service center, analysis can immediately be undertaken on the received data for determining the cause of the fault and possibly for suggesting derating of certain operational features to prevent further damage to the vehicle. Further, in one embodiment, the on-board monitor includes a device for determining vehicle location, for example, a global positioning system receiver. In this embodiment, location information can also be provided to the remote site so that a repair crew can be dispatched to the vehicle.

The process of providing the vehicle operational information to a remote site, e.g., a monitoring and diagnostic service center, requires the creating of a communications link between the two points. This link can be established using satellite communications or terrestrial communications, including cellular, personal communications, microwave, etc. As applied to an embodiment where the on-board monitor is on a locomotive, typically satellite communications is utilized since the locomotive may frequently be outside the range of available terrestrial communications systems. In one embodiment, transmission control protocol/internet protocol (TCP/IP) is utilized on the communications channel.

Whether the link comprises satellite communications or terrestrial communications, delays are encountered in the transmission process. The first delay is simply the time required to close the communications link from the vehicle to the remote site (or in reverse, for transmissions from the remote site to the vehicle). A second delay element is introduced by the transit time, i.e., the time interval between transmitting the first bit from the vehicle and receiving the first bit at the remote site. There is also a latency delay between individual files as each file is taken from the queue and prepared for transmission. The total latency is a function of the number of files to be transmitted. When a vehicle experiences a fault, it is important to transfer all operational parametric information to the remote site so that a complete and thorough diagnosis can be undertaken there. Therefore, transmission of a significant number of files may be required when a fault occurs, creating significant total latency due to the latency period between each transmitted file. Also, errors during transmission require retransmission of the file and thus add to the delay. Even in those situations where forward error correction is employed, performing the forward error correction on the received data consumes a certain amount of time. Finally, all communications links are prone to failure, i.e., the link simply goes down or the bit error rate or signal strength renders the link unusable. Also, in the embodiment where the vehicle is a locomotive, the links is lost whenever locomotive enters a tunnel. As is known, wireless environments pose more challenges with respect to links outages than wired environments.

It must also be recognized that the file that was being transmitted when the link was lost, must be completely retransmitted again. The data in the file is worthless until the last file bit arrives at its destination. All of these factors contribute to transmission delays and according to the teachings of the present invention are minimized to allow the early receipt of information at the remote site so that data analysis can begin at the earliest possible time.

BRIEF SUMMARY OF THE INVENTION

The method and apparatus in conjunction with the present invention categorizes the various types of data to be downloaded from the vehicle to the remote site and further identifies an appropriate downloading strategy. Certain relatively high priority files (e.g., related to serous faults or emergency conditions) are downloaded prior to downloading lower priority files. In this way, data analysis at the receiving site begins immediately after the high priority files are downloaded, thereby saving processing time that would otherwise require the downloading of the low priority files before processing the received information. Further, the number of files is reduced to reduce network latency, especially the network latency that arises between each file, by merging similar files. But the file lengths are not permitted to become so long so as to create problems if the link is lost during transmission of the file. To reduce network latency to its lowest possible value, all files can be combined into one super file. However, when the link is lost the entire file must be retransmitted. Therefore, the process of selectively combining related files results in the optimum file transfer characteristics.

BRIEF DESCRIPTION OF THE DRAWINGS

The present invention can be more easily understood and the further advantages and uses thereof more readily apparent, when considered in view of the description of the preferred embodiments below and the following figures in which.

DETAILED DESCRIPTION OF THE PREFERRED EMBODIMENTS

Figure 1:
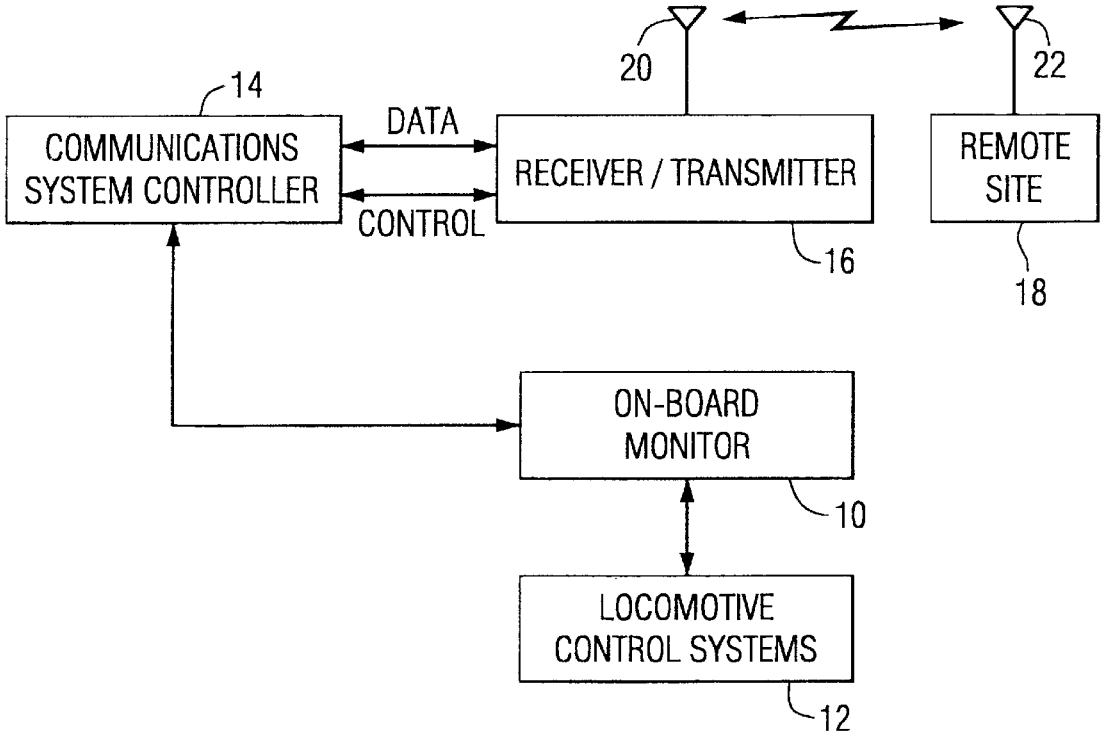
FIG. 1 is a block diagram of a vehicle communications system to which the teachings of the present invention can be applied.

Before describing in detail the particular file transfer mechanism in accordance with the present invention, it should be observed that the present invention resides primarily in a novel combination of processing steps and hardware elements related to a vehicle communications system and the transfer of files therefrom. Accordingly, the processing steps and hardware components have been represented by conventional elements in the drawings, showing only those specific details that are pertinent to the present invention so as not to obscure the disclosure with structural details that will be readily apparent to those skilled in the art having the benefit of the description herein.

FIG. 1 illustrates one embodiment of the environment to which of the present invention can be applied. A locomotive on-board monitor 10 is coupled to plurality of locomotive control systems, depicted generally by a reference character 12. The specific nature and function of the locomotive control systems 12 are not germane to the present invention, except to the extent that the on-board monitor 10 monitors various parameters associated with the operation of these control systems. The data collected by the on-board monitor 10 provides important locomotive performance and status information and is analyzed at a remote monitoring and diagnostic center to identify active faults, predict incipient failures and provide timely information concerning existing operating conditions.

The on-board monitor 10 is bi-directionally coupled to a communications system controller 14 for controlling a receiver-transmitter 16 over data and control lines as shown in FIG. 1. The receiver/transmitter 16 communicates with a remote site 18 via intervening antennas 20 (coupled to the receiver/transmitter 16) and 22 (coupled to the remote site 18). In one embodiment, the remote site 18 comprises a monitoring and diagnostic service center for analyzing the information collected by the on-board monitor 10.

The on-board monitor 10 functions as a data acquisition, conditioning, processing and logging instrument that provides status information to the remote site 18 via the bi-directional communication path as shown. Certain parametric and fault-related information gathered by the on-board monitor 10 is collected and stored in the form of raw data files. Other collected data is used to create operational statistics and stored as statistical parameters. Both the raw data files and the statistical data files are downloaded to the remote site 18 on a periodic basis. Upon the occurrence of a critical or significant fault or failure, the periodic transmissions process is preempted by an immediate download, providing for immediate analysis of the data to correct the fault and possibly avoid additional damage to the locomotive.

The remote site 18 uploads operational and configuration commands to the on-board monitor 10 for controlling the data collection process. In the embodiment where the remote site 18 is a monitoring and diagnostic service center, the data analysis process is performed there by review of the received operational information by human repair experts and software-based analysis In one embodiment, the on-board monitor 10 includes a processor and its attendant components including interface devices for communicating bi-directionally with the locomotive control systems, input devices, storage devices and output devices. Programming of the processor controls operation of the on-board monitor 10, including especially the operational parametric information to be collected and the collection frequency. The control scheme can be stored in the on-board monitor 10 and/or uploaded to the processor in the form of a configuration file. As is known to those skilled in the art, the processor for the on-board monitor 10 may comprise a dedicated processor or another processor aboard the locomotive, such as within the communications system controller 14 or the locomotive control systems 12, can execute the necessary software programs to provide the on-board monitoring function.

As is known to those skilled in the art, there are a number of appropriate terrestrial or satellite based communications system that can be used to create the link between the receiver/transmitter 16 and the remote site 18. For example, the communications system can comprise a cellular telephone system, a satellite phone system or a point-to-point microwave system. Since the locomotive spends considerable time in transit moving either freight or passengers, sometimes in remote regions, it has been observed that a satellite-based link provides the most reliable communications media between the locomotive and the remote site 18. With respect to the present invention, the communications scheme offers minimum latency during the data transmission process, while ensuring a reliable link as the locomotive travels in both remote and urban regions.

The process of transferring information between two points always includes certain delays and latencies depending upon the network type and the nature of the transmitted data. Efficient network management and data transfer requires minimization of delays and latencies. Further, generally there is a cost per time interval for using the network. The user is therefore paying for network air time that is being consumed by delays, rather than the transmission of information. In addition to network latencies, the data transfer rate is dependent upon the file size and the quality of the communications link employed. Generally, files collected by the on-board monitor 10 range in size from 1 kB to 100 kB, with typical values in the 10 kB to 50 kB range. The transmission of long files reduces data transfer latency by reducing the latency time between each file. However, there is also a disadvantages in this scheme given that the file transfer is not complete and therefore the file is not useful until the last data bit has been received. Therefore, whenever the link is lost during file transfer, the complete file must be retransmitted. Obviously, longer files have a greater probability of interruption prior to the completion of file transfer. Alternatively, shorter files provide more efficient data transfer; if the link is lost during a short file, retransmission will take a relatively short time. However, disadvantageously, short files increase the network latency due to the delay between each of the short data files.

The link quality as measured in signal to noise ratio or bit energy to noise ratio also impacts the data transfer characteristics. If the link is highly reliable, file transfers will be made without loss of bits during the file transfer. If the link is frequently lost or fades then the data transfer will be negatively impacted.

In one embodiment to which the teachings of the present invention are applicable, the transmission path shown in FIG. 1 is implemented with a mobile satellite link between the locomotive (or other mobile asset) including the on-board monitor 10 and the remote site 18, including a remote monitoring and diagnostic service center. The receiver/transmitter 16 is implemented with a Westinghouse Wireless Series 1000 Satellite Terminal for communicating with an L-band, circuit-switched voice and data satellite transponder in geostationary orbit. In one embodiment the link data rate is 4800 bits per second. The signal received at the geostationary satellite from the receiver/transmitter 16 is downlinked to a satellite earth station hub. Typically, leased lines or a microwave system link the satellite earth station hub with the remote site 18. The remote site 18 includes a plurality of modems, referred to as a modem pool, and communications servers for receiving the downloaded data and making it available to personnel at the remote site 18. The teachings of the present invention focus on improvements to the communications process of data transfer.

Figure 2:
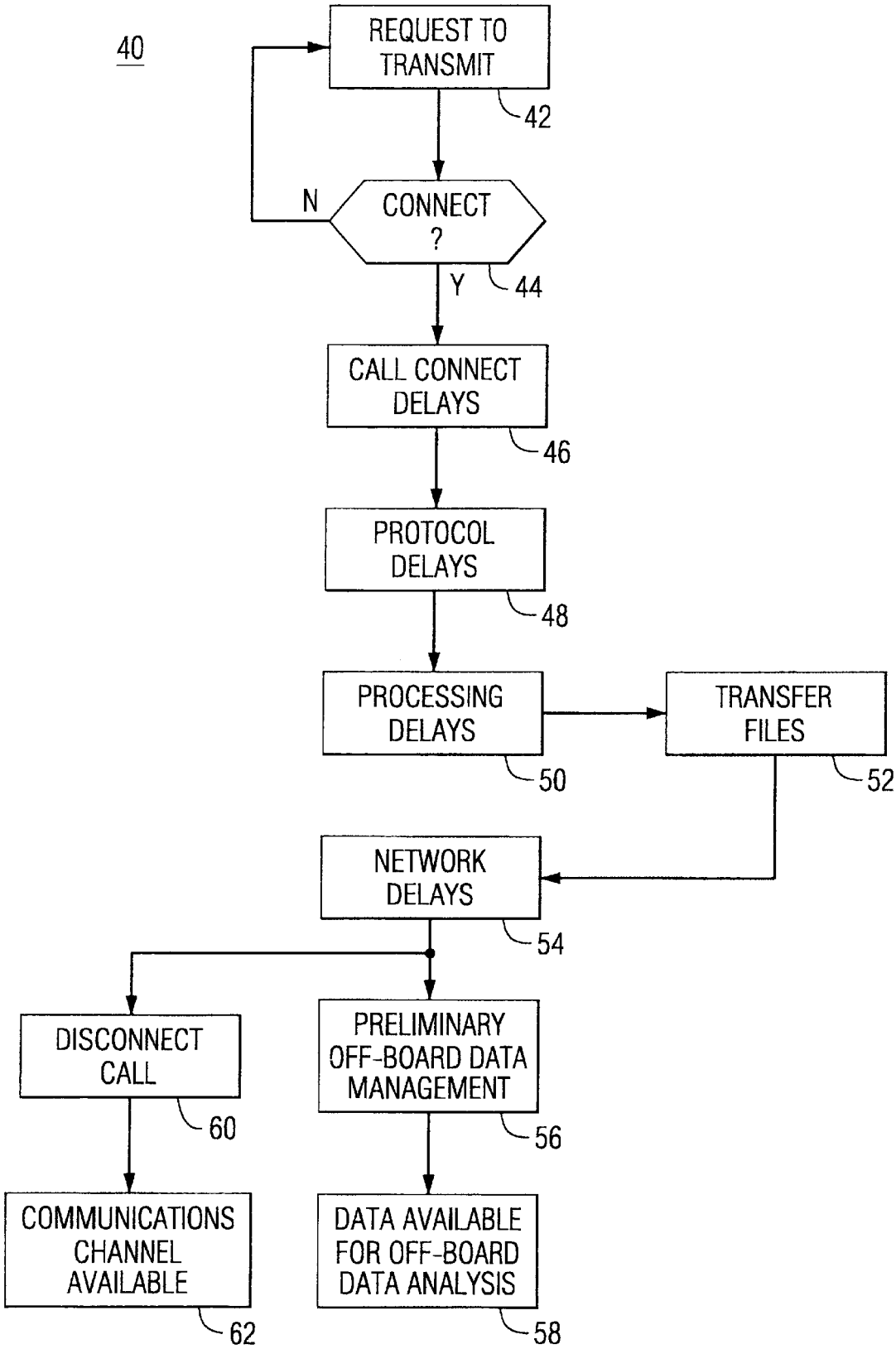
FIGS. 2 and 3 are flow charts illustrating a file transfer process.

FIG. 2 illustrates a file transfer process 40 including the various delays associated with the transmission of information from the vehicle to the remote site 18. At a step 42, a request to transmit is sent to the communication system controller 14. The request can be made periodically (with a period as set forth in the configuration file for the on-board monitor 10), in response to a fault on board the locomotive or in response to a request from the remote site 18. In the situation where requests are made on a periodic basis, a timer can be employed. Once a request to transmit is initiated, processing moves to a decision step 44 where an attempt is made to connect with the remote site (or vice versa if the request originates from the remote site 18). If the attempt is not successful, processing returns to the step 42 for initiation of another transmission request.

In the event the communications connection is closed between the vehicle and the remote site 18, processing moves from the decision step 44 to a step 46. As discussed above, the communications between the vehicle and the remote site 18 can be established using one of many satellite or terrestrial systems. The step 46 represents an aggregation of the delays associated with the process of closing the link between the vehicle and the remote site 18, and negotiating the network parameters. Once the link is closed, the communications devices at the vehicle and the remote site 18 exchange necessary protocol information. This process is commonly referred to as a handshake routine, and the delays associated with the handshake process are represented by a step 48. Processing delays are represented by a step 50. These delays include the time for preparing the data files for transmission, including tarring or merging and then compressing the files prior to transmission. Note that files of differing priorities will likely be tarred. At a step 52, the files are transferred from the vehicle to the remote site 18. Although the file transfer process 40 as described in conjunction with FIG. 2 refers to the transfer of files from the vehicle to the remote site 18, these same steps apply when files are transferred in the opposite direction.

The network delay associated with file transfer process is indicated by a network delay step 54. The most significant contribution to the network delay is the transit time of the information from the vehicle to the remote site 18. One measurement of the network delay is the time between transmission of the first file bit from the vehicle to the time of receipt of the last file bit at the remote site 18. Only after the last bit is received is the file ready for use at the receiving end.

Preliminary off-board data management (see a step 56) can be performed on the data file after it has been received. For example, this step can include the decompression, detarring and error correcting of the received data file. After the preliminary data management has been completed, the data is available for analysis at the remote site. This function is indicated at a step 58. When the last file is received the call is disconnected by tearing down the communications link. The disconnect process is illustrated at a step 60. Once the call has been disconnected, the communications channel is again available (see a step 62) for establishing a communications link in response to another request to transmit a data.

Figure 3:
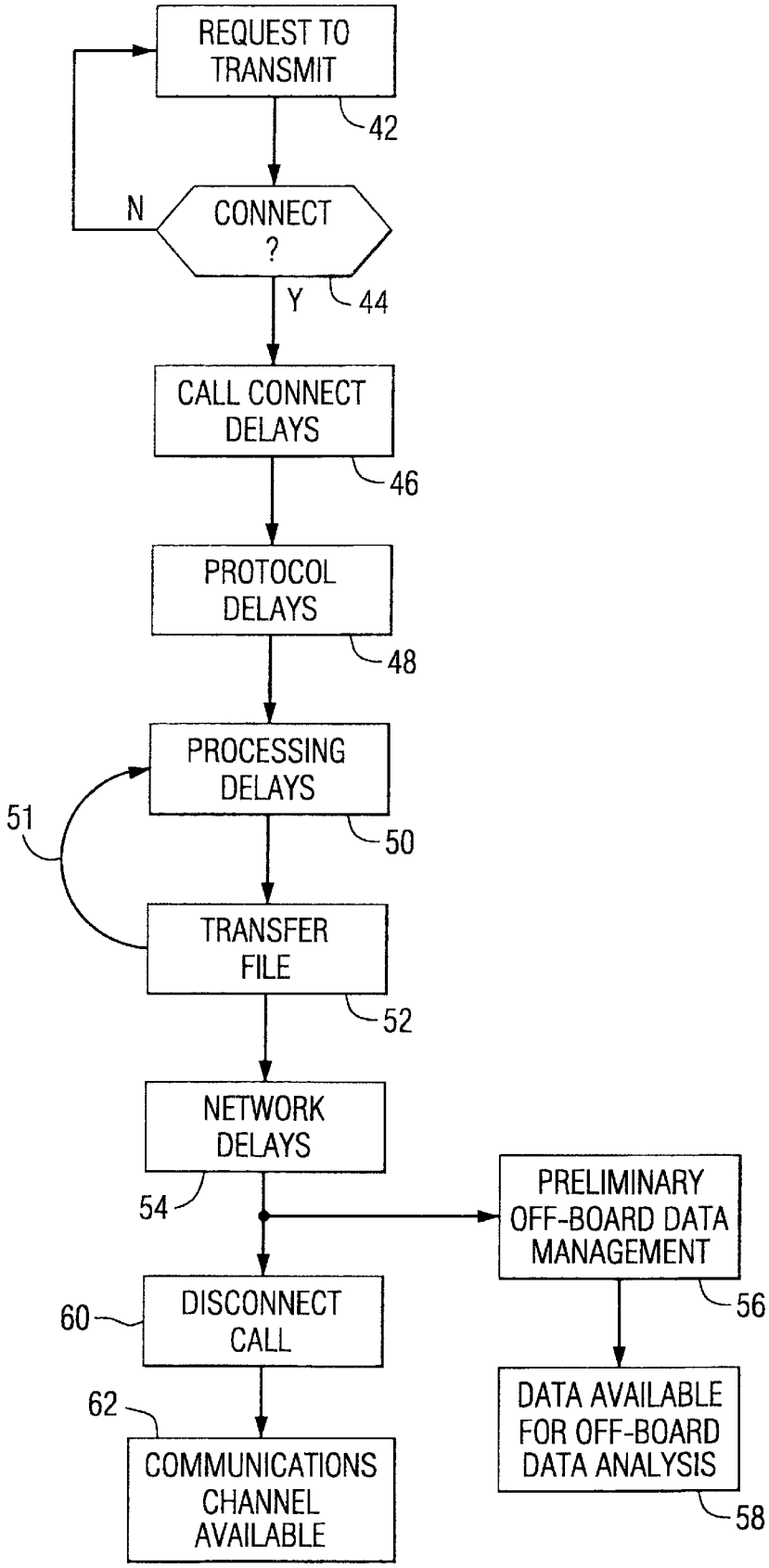

The FIG. 3 flowchart is similar to the flowchart of FIG. 2, except FIG. 3 illustrates the transfer of a plurality of files using a loop back path 51 between the transfer files step 52 and the processing delays step 50. The files are transferred serially so that when the transfer of one file is complete, transferring of the next file begins. Thus, there is a processing delay between each file transferred, which significantly protracts the time required to transfer all files. In the FIG. 3 embodiment, each file created by the on-board monitor 10 is transferred individually and independently as a unique file to the remote site 18. As discussed in conjunction with FIG. 2, each file is available for data analysis at the remote site 18 immediately after the file transfer process is completed. However, this advantage of having files immediately available for analysis at the remote site 18 is offset by the processing delay encountered between each file transfer. Additionally, in the FIG. 3 embodiment, the files are randomly transferred as they are made available by the on-board monitor 10. The files are not prioritized and therefore, the most significant files from the standpoint of vehicle operation and analysis will not necessarily be transferred first.

Figure 4:
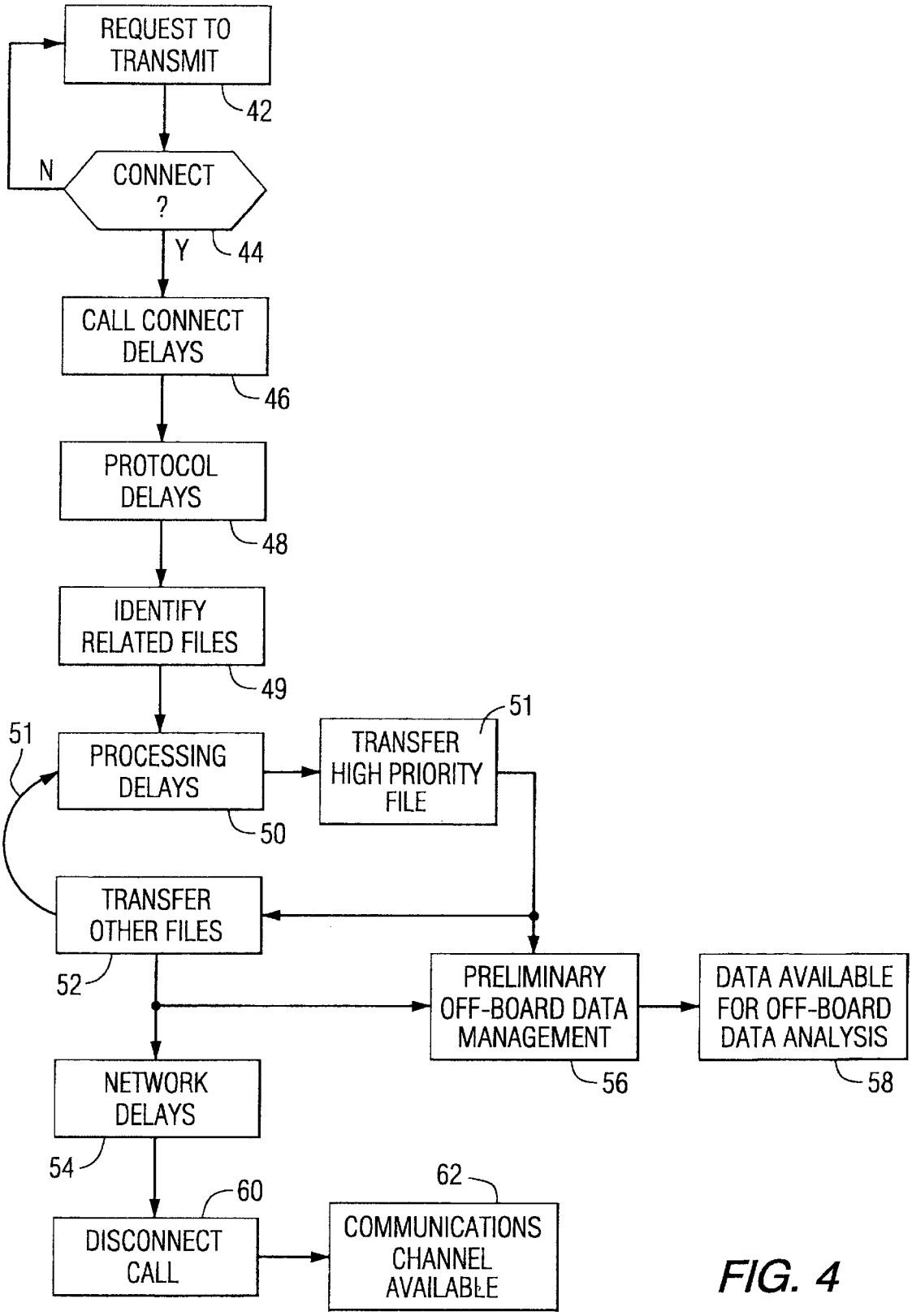
FIG. 4 is a flow chart illustrating a file transfer process in accordance with the teachings of the present invention.

FIG. 4 is the preferred file processing strategy incorporating the teachings of the present invention. In this embodiment, the most significant or highest priority (time critical) files are identified and downloaded first. In general, these files relate to a locomotive fault with a potential for causing serious damage or to a locomotive line of service failure. Under these conditions, it is important to provide immediate data analysis and the creation of repair recommendations. Note, this is a reactive, not a proactive, analysis mode. At the other end of the spectrum, the low priority data typically comprises daily operational parameter downloads. Under these circumstances, the locomotive is in service and the data analysis is based on a proactive model wherein the data is analyzed in an effort to identify potential or incipient problems. Although numerical download time objectives are dependent upon the nature of the data and service duty of the vehicle, in one embodiment the FIG. 4 process provides for downloading the highest priority files in less than approximately two minutes, while the lower priority files can take in excess of 15 minutes.

Turning now to FIG. 4, several steps are shown therein bearing identical reference characters and representing identical processes as those steps shown in FIGS. 2 and 3. A step 49 interposed between the steps 48 and 50 represents the process of identifying related files stored in the on-board monitor 10. In one embodiment of the on-board monitor 10 there are four data file types ranging from the most critical fault related files, which include details of the specific fault and the related vehicle operational parameters as measured near the time of the fault occurrence. The anomaly data is next in priority ranking. The anomaly information, which is used to predict potential vehicle failures, includes operational parameters that are beyond a predetermined limit or range of expected values and therefore are possible indicators of potential problems. The next file type, in order of descending priority, is the operational log for the on-board monitor 10. The log is a record of various events related to the on-board monitor 10, including attempts to establish a communications link with the remote site 18 and failures internal to the on-board monitor 10. The next priority file type includes fault reset information. Many of the faults are transient in nature and the disrupted system can be reset once the fault has cleared. The fault reset file collects this reset information. The signal strength file is next in priority. This file includes signal strength data, as measured at various times, over the communications link with the remote site 18. Finally, the lowest priority files are those providing so-called "daily download information." This is routine operational information collected by periodically by the on-board monitor 10. Because of the significant volume of the daily download data, in one embodiment, statistical measures are calculated and transmitted to the remote site 18, in lieu of transmitting the raw data.

Returning to FIG. 4, once the related files are identified, they are tarred and compressed during the processing delays step 40. The high priority data files are transferred at a step 51, after which preliminary off-board (i.e., at the remote site 18) management is initiated at a step 56. The data files are then available for detailed analysis, as shown at a step 58, at the remote site 18.

At a step 52 the next lower priority level of files are transferred. The data transfer process loops between the processing delays step 50 and the file transfer step 52 until all of the files are transferred. From that point, the FIG. 4 process is identical to the processed illustrated in FIGS. 2 and 4. Thus, it is seen that prioritizing the most critical files, merging only related files, transmitting them as a group (or even a single file) minimizes the file transfer time (thereby reducing file transfer latency) and allows for the early analysis of these files at the remote site 18. The teachings of the present invention apply whether the data is downloaded to the remote site 18 under control of the on-board monitor 10 or whether the download occurs in response to a request from the remote site 18.

While the invention has been described with reference to a preferred embodiment, it will be understood by those skilled in the art that various changes may be made and equivalent elements may be substituted for elements thereof without departing from the scope of the invention. In addition, modifications may be made to adapt a particular situation to the teachings of the present invention without departing from the essential scope thereof. Therefore, it is intended that the invention not be limited to the particular embodiment described as the best mode for carrying out this invention, but that the invention will include all embodiments falling within the scope of the appended claims.

What is claimed is:

1. For use with a self-powered land-based vehicle comprising a plurality of operational systems, wherein the vehicle is in selective communication with a remote site over a wireless limited bandwidth communications link, said method comprising:

(a) sensing information indicative of the operation of the vehicle operational systems, constituting vehicle operational information;

(b) storing said operational information in a plurality of files;

(c) analyzing said operational information for it relevance to the health of the operational systems;

(d) setting priorities among the plurality of files based on their respective relevance to the health of the operational systems; and (e) transmitting higher priority files to the remote site before transmitting lower priority files.

2. The method of claim 1 wherein the self-powered land-based vehicle is a railroad locomotive.

3. The method of claim 1 further comprising transmitting to a monitoring and diagnostic center where the vehicle operational information is analyzed.

4. The method of claim 1 further comprising compressing the higher priority files.

5. The method of claim 1 wherein the higher priority files are related to a vehicle fault.

6. The method of claim 1 further comprising:

selecting at least two higher priority files;

merging the at least two higher priority files; and transmitting the merged at least two higher priority files.

7. The method of claim 1 further comprising;

transmitting the highest priority file to the remote site;

selecting the next lower priority file from among the plurality of files;

transmitting the next lower prior files to the remote site; and continuing to select and transmit files in descending order of priority until all of the plurality of files have been transmitted to the remote site.

8. For use with a self-powered land-based vehicle comprising a plurality of operational systems, wherein said vehicle is in selective communication with a remote site over a limited bandwidth wireless communications link, said vehicle comprising:

a first module for sensing information indicative of the operation of the vehicle operational systems, constituting vehicle operational information;

a second module for storing said operational information in a plurality of files;

a third module for analyzing said operational information for its relevance to the health of the operational systems;

a fourth module for setting priorities among the plurality of files based on their respective relevance to the health of the operational systems; and a transmitter for transmitting the higher priority files to the remote site before transmitting the lower priority files.

9. The on-board monitor of claim 8 wherein the self-powered land-based vehicle is a railroad locomotive.

10. The on-board monitor of claim 9 wherein the fourth module merges and compresses the higher priority files.

11. The on-board monitor of claim 9 wherein the higher priority files are related to a vehicle fault.

* * * * *